US006877626B2

(12) United States Patent
Sherrod

(10) Patent No.: US 6,877,626 B2
(45) Date of Patent: Apr. 12, 2005

(54) SPILL PROOF CAP FOR DIFFERENT SIZED BOTTLE OPENINGS

(76) Inventor: Joseph Sherrod, 8417 33rd Ave. North, Crystal, MN (US) 55427

( * ) Notice: Subject to any disclaimer, the term of this patent is extended or adjusted under 35 U.S.C. 154(b) by 0 days.

(21) Appl. No.: 10/334,075

(22) Filed: Dec. 30, 2002

(65) Prior Publication Data

US 2004/0124170 A1 Jul. 1, 2004

(51) Int. Cl.[7] ..... B67B 3/00
(52) U.S. Cl. ..... 215/319; 215/388; 220/287
(58) Field of Search ..... 220/287, 716, 220/717, 718; 215/319, 388, 274, 276, 11.4, 44

(56) References Cited

U.S. PATENT DOCUMENTS 1,337,034 A * 4/1920 Bauermeister ..... 215/230
3,690,496 A * 9/1972 Gibson ..... 215/217
4,747,501 A * 5/1988 Greaves ..... 215/253
5,105,956 A * 4/1992 Tarng-Lin ..... 215/11.1
5,269,425 A * 12/1993 Gomez-Acevedo ..... 215/11.1
5,295,597 A * 3/1994 Green ..... 215/11.4
5,340,228 A * 8/1994 Wilcox et al. ..... 401/262
5,551,583 A * 9/1996 Sachathamakul et al. ... 215/386
5,890,620 A * 4/1999 Belcastro ..... 220/714
5,890,621 A * 4/1999 Bachman et al. ..... 220/717
5,938,053 A * 8/1999 Verbovszky et al. ..... 215/6
6,390,315 B1 * 5/2002 Giddings et al. ..... 215/235

* cited by examiner

*Primary Examiner*—K. T. Nguyen
(74) *Attorney, Agent, or Firm*—Brendan C. Babcock

(57) ABSTRACT

A device which has a cap having connection means of multiple geometries such that connection can be made with a variety of bottle openings and a valve to inhibit spillage through the cap.

16 Claims, 2 Drawing Sheets

SPILL PROOF CAP FOR DIFFERENT SIZED BOTTLE OPENINGS

BACKGROUND OF THE INVENTION

There are a variety of caps on the market. There are the caps used for children's sippy cups. Some bottles have pull top screw caps that you see on sports bottles, bottled water, etc. There are also the screw caps that are twisted to open and twisted to close. However all of these caps require a mechanical movement between the open and closed positions.

In many instances a cap that is spill proof and which does not require a mechanical movement between the open and closed position is desirable. To sip from such a cup is much more simple and convenient than the conventional bottle screw tops.

There are instances when multiple bottles of fluid are desired and perhaps have different screw diameters. In such instances, a screw cap having multiple thread grooves is of great benefit. With a young child such a cap would allow multiple bottles to be used while using the same effective non-spill screw cap. It would also allow for the purchase of adult bottles of fluid with a standard cap. Bottles with standard caps require less manufacturing and are typically less expensive.

As there are several standard sized bottle thread geometries, a device having such a cap with multiple adapters would allow for a wider array of geometries.

There remains a need for a cap or a device having multiple bottle thread geometries.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well for the purposes of complying with 37 C.F.R. 1.72.

BRIEF DESCRIPTION OF THE INVENTION

The present invention in some of its embodiments provides a device having a screw cap with multiple sealing threads and a valve to inhibit spillage throught the cap.

Another embodiment has at least one adapter with thread geometries sized differently from the cap. The threading on the adapter may be on both the inside and the outside of the adapter.

Another embodiment has at least one adapter having thread geometries different from those of the cap can engage the device to a container with thread geometries different from that of the cap.

Another embodiment has at least one adapter with thread geometries on both the inside of the adapter and the outside of the adapter.

Another embodiment has at least one adapter with multiple sets of thread geometries on the outside of the adapter.

Another embodiment has at least one adapter with multiple sets of thread geometries on the inside of the adapter.

Another embodiment has a cap with a mouth piece taken from the group consisting of: nipples, passifiers, sippy cup construction, flip tops, turn and screw construction, tubular, or any combination thereof.

Another embodiment has a construction selected from the group consisting of glasses, plastics, acrylics, metals, rubbers, or any combination thereof.

Another embodiment has a cap having connection means of multiple geometries such that connection can be made with a variety of bottle openings and a valve to inhibit spillage through the cap.

In another embodiment the connection means is selected from the group comprising snap in place means, frictional means, pressure means, clamping means, or any combination thereof.

Another embodiment has an adapter configuration such that the screw cap can be used with a container with a female threading configuration.

These and other embodiments which characterize the invention are pointed out with particularity in the claims annexed hereto and forming a part hereof. However, for a better understanding of the invention, its advantages and objectives obtained by its use, reference should be made to the drawings which form a further part.

BRIEF DESCRIPTION OF THE SEVERAL VIEWS OF THE DRAWING(S)

A detailed description of the invention is hereafter described with specific reference being made to the drawings.

DETAILED DESCRIPTION OF THE INVENTION

Figure 1:
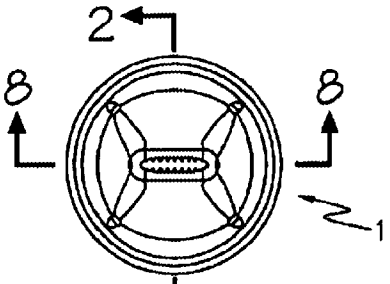
FIG. 1 is a bottom view of the cap.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
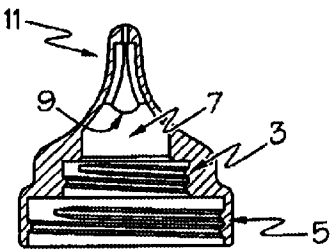
FIG. 2 is a cross-sectional perspective view of the cap along the line A—A showing the different connecting means geometries and check valve.
Figure 3:
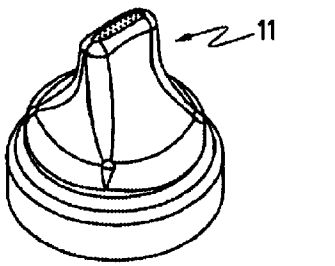
FIG. 3 is a perspective view of the cap from an upper angle.

In FIG. 1 a bottom view of the cap 1 is shown. In FIG. 2 the smaller diameter connection means 3 and the larger diameter connection means 5 are shown. All the connection means in this application can include those connection means including sealing threads, snaps (any variety in which one portion slides over a lip on one member and reaches a smaller diameter portion), solely frictional methods, etc. Here sealing threads are shown as most drinking containers use threads. The liquid recovery chamber 7 is the portion of the cap 1 wherein the liquid must pass before passing through the check valve 9. The check valve 9 is designed to prevent flow through the mouthpiece 11 in the absence of a vacuum condition created by the user.

In FIGS. 3–6 one mouthpiece design is shown from different perspectives. Other mouthpieces can be used with this invention such as nipples or flip tops such as those on water bottles.

Figure 4:
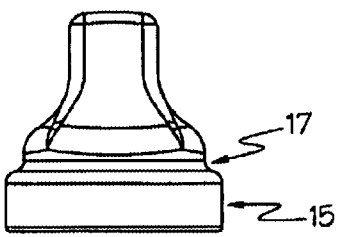
FIG. 4 is a side view of the cap with the broad portion of the mouthpiece shown.
Figure 5:
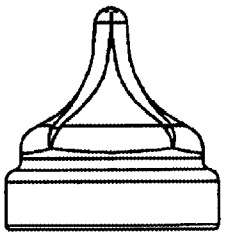
FIG. 5 is a side view of the cap with the narrow portion of the mouthpiece shown.

Depending on the size of the bottle being fitted, smaller threads 3 and larger threads 5 are engaged to the bottle. Liquid retaining walls 15 and 17 as shown in FIG. 4 correspond respectively to threads 5 and 3. These walls retain the fluid inside the chamber 7.

Figure 6:
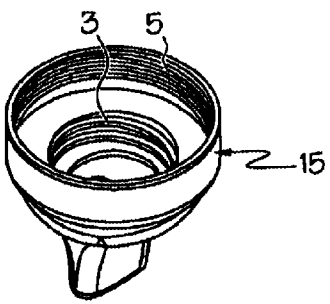
FIG. 6 is a perspective view of the cap from a lower angle.
Figure 10:
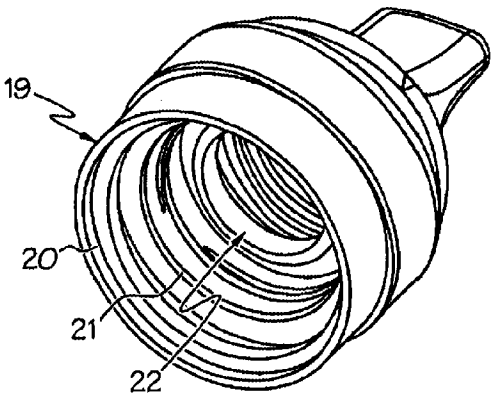
FIG. 10 is a lower angle perspective view of the cap with the engaged adapter.
Figure 9:
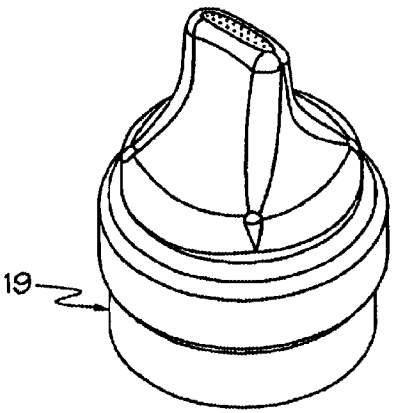
FIG. 9 is an upper angle perspective view of the cap with an engaged adapter.

In FIG. 6 the different sealing thread geometries 3 and 5 are shown. Smaller diameter threaded containers will screw into sealing threads 3 and the larger screw diameter containers will screw into sealing threads 5. As there is a number of different sized diameter threaded containers, an adapter 19 as shown in FIG. 9 may be used. Such an adapter 19 can be screwed into the cap and as shown in FIG. 10 can have a collection of different sealing thread diameters 20, 21, and 22.

Figure 12:
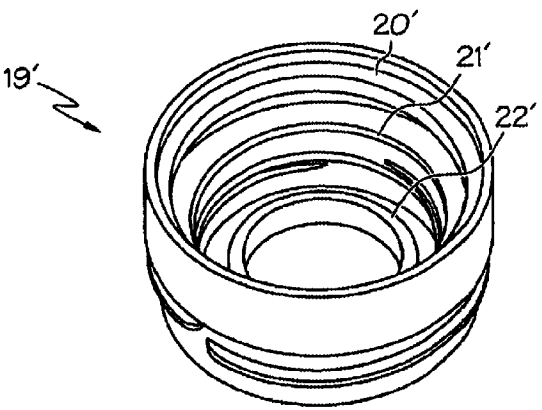
FIG. 12 is a lower angle perspective view of an adapter.
Figure 11:
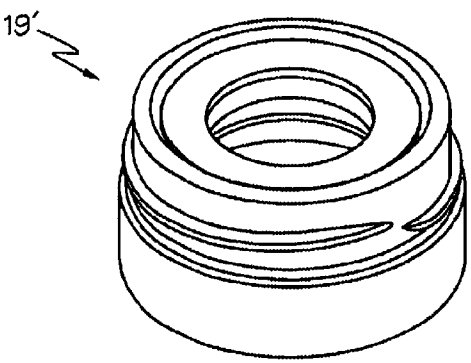
FIG. 11 is an upper angle perspective view of an adapter.

In FIGS. 11 and 12 the adapter 19' is shown. Adapter 19' can be sized to fit adapter 19 on one side and on the other side it can be designed to fit an array of different diameter threaded containers through another collection of different sealing thread diameters 20', 21', and 22' of adapter 19'.

Figure 7:
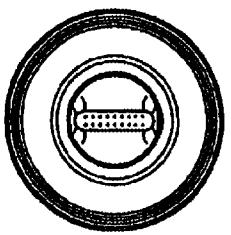
FIG. 7 is a top view of the cap.
Figure 8:
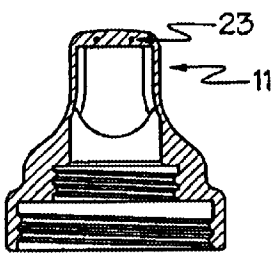
FIG. 8 is a cross-sectional perspective view of the cap along the line B—B showing the different connecting means geometries and check valve.

In FIG. 7 liquid intake hole 23 opens to liquid recovery chamber 7 and as shown in FIG. 8 the liquid outtake opening 25 of mouthpiece 11 is an opening of two holes which are designed to impede the flow of fluid through the cap when the bottle is dropped or tipped over.

At least one of the threads fit that of a standard size baby bottle. The nipples for these bottles can be attached to this invention in at least one embodiment. Rather than having a mouthpiece integral to the cap, the cap can be designed to fit over or around a wide variety of mouthpieces which can be attached to the top of the cap. In this fashion, the same bottles can be fitted with the inventive device such that many mouthpieces including a nipple or passifier for an infant can be used.

The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

I claim:

1. A device comprising:

a) a cap having connection means of multiple geometries such that connection can be made with a variety of bottle openings;

b) a valve to inhibit spillage through the cap; and c) at least one adapter has connection means having geometries different from those of the cap and can engage the device to a container with connection means having geometries different from that of the cap.

2. The device of claim 1, wherein the connection means is selected from the group comprising nap in place means, frictional means, pressure means, clamping means, or any combination thereof.

3. The device of claim 1, including at least one adapter having connection means having different geometries on both the inside of the adapter and the outside of the adapter.

4. The device of claim 3, wherein the at least one adapter has multiple sets of connection means geometries on the outside of the adapter.

5. The device of claim 3, wherein the at least one adapter has multiple sets of connection means geometries on the inside of the adapter.

6. The device of claim 1, wherein the cap has a mouth piece taken from the group consisting of: nipples, passifiers, sippy cup construction, flip tops, turn and screw construction, tubular, or any combination thereof.

7. The device of claim 1 constructed from the group consisting of glasses, plastics, acrylics, metals, rubbers, or any combination thereof.

8. The device of claim 1 having a longitudinal axis, the connection means annular about the axis.

9. A device comprising:

a) a cap having multiple thread geometries;

b) a valve to inhibit spillage through the cap; and c) at least one adapter having thread geometries different from those of the cap, the at least one adapter capable of engaging the device to a container with thread geometries different from that of the cap.

10. A device comprising:

a) cap having multiple thread geometries;

b) a valve to inhibit spillage through the cap; and c) at least one adapter having thread geometries on both the inside of the adapter and the outside of the adapter.

11. The device of claim 10, wherein the at least one adapter has multiple sets of thread geometries on the outside of the adapter.

12. The device of claim 10, wherein the at least one adapter has multiple sets of thread geometries on the inside of the adapter.

13. A device comprising:

a) a cap having connection means of multiple geometries such that connection can be made with a variety of bottle openings;

b) a valve to inhibit spillage through the cap; and c) at least one adapter having connection means having geometries different from those of the cap, the at least one adapter capable of engaging the device to a container with connection means having geometries different from that of the cap.

14. A device comprising:

a) a cap having connection means of multiple geometries such that connection can be made with a variety of bottle openings;

b) a valve to inhibit spillage through the cap; and c) at least one adapter having connection means having different geometries on both the inside of the adapter and the outside of the adapter.

15. The device of claim 14, wherein the at least one adapter has multiple sets of connection means geometries on the outside of the adapter.

16. The device of claim 14, wherein the at least one adapter has multiple sets of connection means geometries on the inside of the adapter.

* * * * *